US011299915B2

(12) United States Patent
Liu et al.

(10) Patent No.: US 11,299,915 B2
(45) Date of Patent: Apr. 12, 2022

(54) SMART ELECTRONIC LOCK AND SUITCASE

(71) Applicant: KUANG-CHI INTELLIGENT PHOTONIC TECHNOLOGY LTD., Guangdong (CN)

(72) Inventors: Ruopeng Liu, Guangdong (CN); Hualei Guo, Guangdong (CN)

(73) Assignee: KUANG-CHI INTELLIGENT PHOTONIC TECHNOLOGY LTD., Shenzhen (CN)

( * ) Notice: Subject to any disclaimer, the term of this patent is extended or adjusted under 35 U.S.C. 154(b) by 660 days.

(21) Appl. No.: 16/319,253

(22) PCT Filed: Jul. 6, 2017

(86) PCT No.: PCT/CN2017/092068
§ 371 (c)(1),
(2) Date: Jan. 18, 2019

(87) PCT Pub. No.: WO2018/014739
PCT Pub. Date: Jan. 25, 2018

(65) Prior Publication Data

US 2019/0264469 A1 Aug. 29, 2019

(30) Foreign Application Priority Data

Jul. 19, 2016 (CN) ..... 201610569630.X
Jul. 19, 2016 (CN) ..... 201620758700.1

(51) Int. Cl.

| | |
|---|---|
| ***E05B 65/52*** | (2006.01) |
| ***E05B 15/04*** | (2006.01) |
| ***E05B 47/00*** | (2006.01) |
| ***G07C 9/00*** | (2020.01) |

(52) U.S. Cl.
CPC ..... *E05B 65/52* (2013.01); *E05B 15/04* (2013.01); *E05B 47/0002* (2013.01); *G07C 9/00817* (2013.01); *G07C 2009/00825* (2013.01)

(58) Field of Classification Search
CPC ..... E05B 65/52; E05B 15/04; E05B 47/0002; G07C 9/00817; G07C 9/00825
See application file for complete search history.

(56) References Cited

U.S. PATENT DOCUMENTS 4,372,590 A * 2/1983 Pilat ..... G07C 9/00182 292/169.13
9,154,486 B1 10/2015 Saylor et al.
(Continued)

FOREIGN PATENT DOCUMENTS

CN 2132808 Y 5/1993
CN 2165195 Y 5/1994
(Continued)

OTHER PUBLICATIONS

Extended European Search Report and Written Opinion for corresponding European App No. 17830373.1, dated Mar. 16, 2020, 5 pages.

*Primary Examiner* — Mark A Williams
(74) *Attorney, Agent, or Firm* — Armstrong Teasdale LLP

(57) ABSTRACT

The present invention relates to a smart electronic lock and a suitcase. The smart electronic lock includes a housing that is enclosed by a front shell and a rear shell and that has an accommodating cavity, a lock cylinder assembly disposed in the accommodating cavity, and two fastening assemblies, where the two fastening assemblies are respectively correspondingly located at an upper portion and a lower portion of the back of the rear shell, the housing is provided with a snap-fit structure that snap-fits to one of the fastening assemblies, the housing is provided with a key assembly that
(Continued)

is fastened and locked to the other fastening assembly, the fastening assembly that is fastened and locked to the key assembly is fixedly connected to the housing, a panel of the front shell is provided with a sensor, a circuit board assembly is provided in the accommodating cavity, and the lock cylinder assembly moves under control of the circuit board assembly, so that when the key assembly is pressed, the other fastening assembly drives the key assembly in an anterior/posterior direction to release from the key assembly. The present invention resolves the problems of low security and complex settings of a coded lock in the prior art.

16 Claims, 13 Drawing Sheets

(56) References Cited

U.S. PATENT DOCUMENTS

| | | | | |
|---|---|---|---|---|
| 10,253,528 | B1 * | 4/2019 | Pukari | E05B 47/0005 |
| 2010/0000273 | A1 * | 1/2010 | Viso Cabrera | G07C 9/00944 70/277 |
| 2013/0014550 | A1 | 1/2013 | Xie et al. | |
| 2013/0067969 | A1 * | 3/2013 | Webb | E05B 65/52 70/78 |
| 2015/0162984 | A1 | 6/2015 | Liu et al. | |
| 2015/0315820 | A1 | 11/2015 | Chen | |
| 2015/0332567 | A1 * | 11/2015 | Adrezin | E05B 47/0009 340/568.1 |
| 2020/0095807 | A1 * | 3/2020 | Yasuda | A45C 13/103 |
| 2020/0379734 | A1 * | 12/2020 | Grant | G07C 9/00817 |

FOREIGN PATENT DOCUMENTS

| | | | | |
|---|---|---|---|---|
| CN | 204457136 | U | | 7/2015 |
| CN | 204492363 | U | | 7/2015 |
| CN | 205778022 | U | * | 12/2016 |
| CN | 205778022 | U | | 12/2016 |
| JP | H08189240 | A | | 7/1996 |
| JP | H09184342 | A | | 7/1997 |
| JP | 2002089101 | A | | 3/2002 |
| JP | 2003293639 | A | | 10/2003 |
| JP | 2014120233 | A | | 6/2014 |
| KR | 100750315 | B1 | | 8/2007 |
| KR | 20140006513 | A1 | | 1/2014 |
| WO | 2015183949 | A1 | | 12/2015 |

* cited by examiner

SMART ELECTRONIC LOCK AND SUITCASE

This application is a National Stage of International Application PCT/CN2017/092068, filed Jul. 6, 2017, published Jan. 25, 2018, as WO2018/014739, under PCT Article 21(2); which claims the priority of Chinese Application No. 201610569630.X, filed Jul. 19, 2016 and Chinese Application No. 201620758700.1, filed Jul. 19, 2016. The contents of the above-identified applications are incorporated herein by reference in their entireties.

TECHNICAL FIELD

The present invention relates to the smart lock technology field, and more specifically, to a smart electronic lock and a suitcase.

BACKGROUND

Common suitcases mostly use a coded lock consisting of numbers, to implement an unlocking function. This type of coded lock has the following disadvantages:

I. Low security: Most coded locks use three digits as their password, and the password can still be obtained through multiple trials even if the password is unknown, to implement unlocking.

II. Complex setting: The initial password of most coded locks is "000". If the password is set to other numbers, the password may be easily forgotten after a long time, rendering the coded lock useless.

III. Simple function: A common coded lock implements locking in a mechanical manner and therefore has only two states: open and closed, and cannot provide any other expanded functions.

SUMMARY

A purpose of the present invention is to provide a smart electronic lock and a suitcase, to resolve the prior-art problems, such as low security and complex settings.

According to an aspect of the present invention, a smart electronic lock is provided, including a housing that is enclosed by a front shell and a rear shell and that has an accommodating cavity, a lock cylinder assembly disposed in the accommodating cavity, and two fastening assemblies, where the two fastening assemblies are respectively correspondingly located at an upper portion and a lower portion of the back of the rear shell, the housing is provided with a snap-fit structure that snap-fits to one of the fastening assemblies in an upward/downward direction, the housing is provided with a key assembly that is fastened and locked to the other fastening assembly in an anterior/posterior direction, the fastening assembly that is fastened and locked to the key assembly is fixedly connected to the housing, a panel of the front shell is provided with a sensor for receiving an optical control signal, a circuit board assembly for converting an optical signal received by the sensor into an electrical signal is provided in the accommodating cavity, and the lock cylinder assembly moves under control of the circuit board assembly, so that when the key assembly is pressed, the other fastening assembly drives the key assembly in an anterior/posterior direction to release from the key assembly.

According to a second aspect of the present invention, a suitcase is provided, including a case body and a case cover, where the foregoing smart electronic lock is disposed between the case body and the case cover.

By implementing the present invention, the smart electronic lock can be manually locked freely, and is unlocked by using an optical control signal, facilitating ease of use for a user and avoiding the problem that the password is forgotten because the lock has not been used for a long time. In addition, the lock cylinder assembly is mounted inside a lock body, preventing the lock from being illegally unlocked by using other methods and featuring optimal security. This type of optical control facilitated unlocking method is novel and original, bringing completely new experience to users. Furthermore, the lock cylinder assembly is controlled by using a circuit. Therefore, other functions may be added by using the circuit, for example, loading a GPS positioning function or a weak current reminder function, to further enhance operational performance of the smart electronic lock.

DESCRIPTION OF EMBODIMENTS

Figure 1:
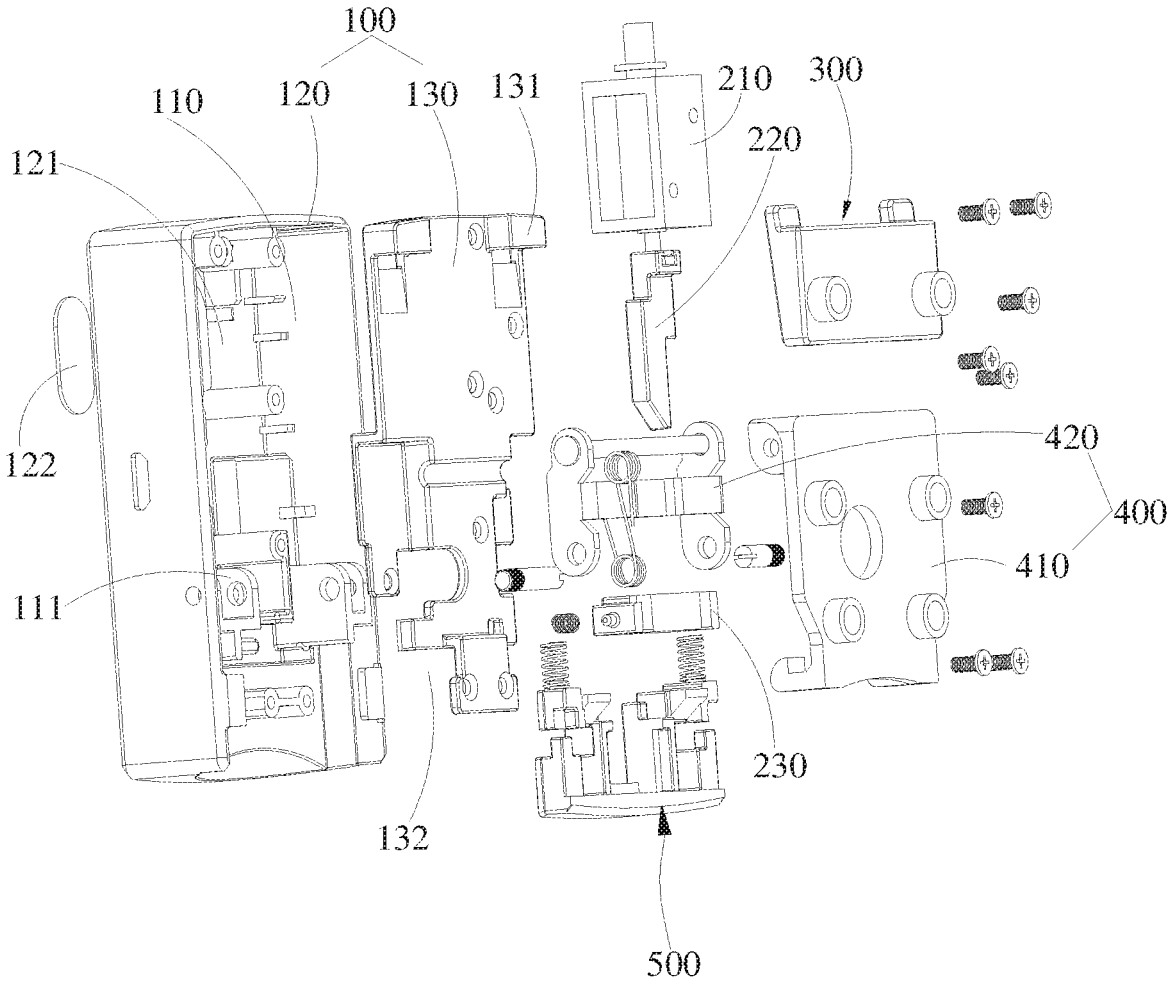
FIG. 1 is an exploded diagram of a smart electronic lock according to an embodiment of the present invention.
Figure 2:
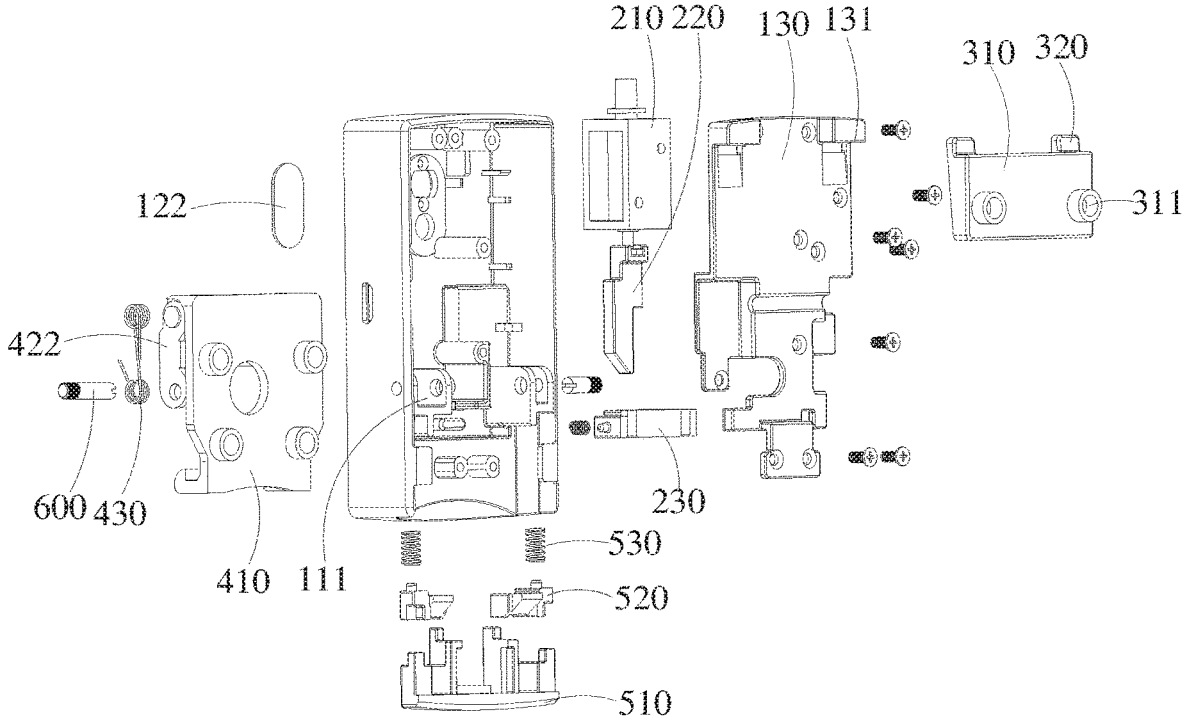
FIG. 2 is an exploded diagram from another angle of a smart electronic lock according to an embodiment of the present invention.
Figure 8:
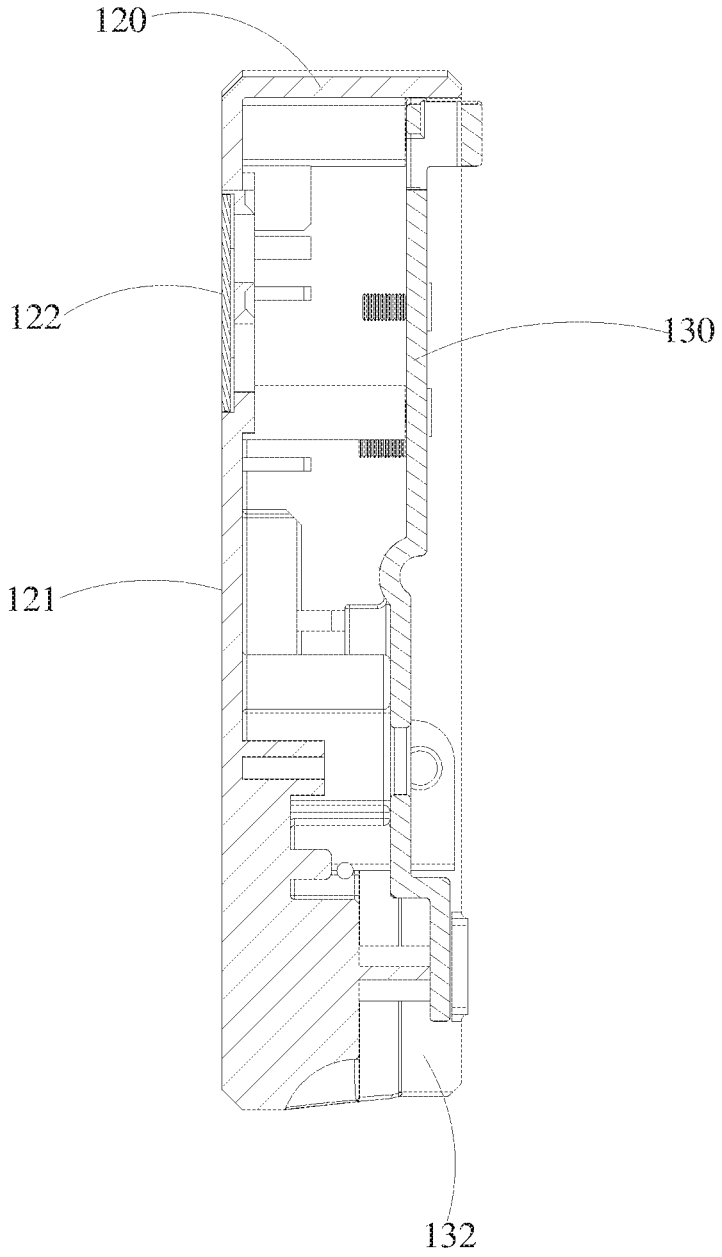
FIG. 8 is a cross-sectional side view of a housing according to an embodiment of the present invention.

Referring to FIG. 1 and FIG. 2, the present invention provides a smart electronic lock, including a housing 100 that has an accommodating cavity 110, a lock cylinder assembly 200 disposed in the accommodating cavity 110, and two fastening assemblies. The housing 100 is enclosed by a front shell 120 and a rear shell 130. The two fastening assemblies are respectively correspondingly located at an upper portion and a lower portion of the back of the rear shell 130. For ease of description, in this embodiment, the two fastening assemblies are respectively named an upper fastening assembly 300 and a lower fastening assembly 400. The upper portion of the rear shell 130 is correspondingly provided with a snap-fit structure 131 that snap-fits to the upper fastening assembly 300 in an upward/downward direction, and the lower portion of the rear shell 130 is correspondingly provided with a key assembly 500 that is fastened and locked to the lower fastening assembly 400 in an anterior/posterior direction. In addition, the lower fastening assembly 400 is fixedly connected to the housing 100. A panel 121 of the front shell 120 is provided with a sensor 122 for receiving an optical control signal, a circuit board assembly (not shown in the figures) for converting an optical signal received by the sensor 122 into an electrical signal is provided in the accommodating cavity 110, and the lock cylinder assembly 200 moves under control of the circuit board assembly, so that when the key assembly 500 is pressed, the lower fastening assembly 400 drives the key assembly 500 in an anterior/posterior direction to release a locking state between the lower fastening assembly 400 and the key assembly 500. In this embodiment, the accommodating cavity 110 is located in the front shell 120 with an opening facing backward. The rear shell 130 is in a platy structure, and the platy structure of the rear shell 130 does not completely enclose the opening of the accommodating cavity 110. With reference to FIG. 8, the lower portion of the rear shell 130 has a mounting hole 132 for mounting the key assembly 500. Unlocking is implemented by pressing the key assembly 500 upwards. When the smart electronic lock is applied to a suitcase or another case-type structure, the upper fastening assembly 300 and the lower fastening assembly 400 are respectively fastened to a case cover and a case body. In addition, the lower fastening assembly 400 is further fixedly connected to the housing 100. The upper fastening assembly 300 on the case cover is configured to preliminarily snap-fit to the snap-fit structure 131 of the housing 100, and the lower fastening assembly 400 on the case body and the key assembly 500 are configured to lock the housing 100 to the case body, that is, to further ensure that the upper fastening assembly 300 on the case cover does not fall off from the snap-fit structure 131 of the housing 100, thereby ultimately locking the case cover and the case body securely. After the lower fastening assembly 400 is unlocked from the key assembly 500, the snap-fit structure 131 and the upper fastening assembly 300 can be easily opened after being released from the enhanced locking. To be specific, the upper fastening assembly 300 is unlocked from the snap-fit structure 131 of the housing 100, so that the case cover and the case body have no restraint therebetween and are in an open state.

Preferably, the sensor 122 in the present invention receives an optical signal from a camera flash of a mobile phone, where the camera flash of the mobile phone sends, by emitting light a blinking manner under control of mobile APP software, an optical signal that carries an unlocking signal.

Certainly, in this embodiment, a fitting structure between the snap-fit structure 131 and the upper fastening assembly 300 may be alternatively disposed at a lower portion of the housing 100, and a fitting structure between the key assembly 500 and the lower fastening assembly 400 is disposed at an upper portion of the housing 100. After the locations are exchanged, unlocking is implemented by pressing the key assembly 500 downwards.

The smart electronic lock according to this embodiment can be manually locked freely, and is unlocked by means of optical control by using a mobile APP, facilitating ease of use for a user and avoiding the problem that the password is forgotten because the lock has not been used for a long time. In addition, the lock cylinder assembly 200 is mounted inside a lock body, preventing the lock from being illegally unlocked by using other methods and featuring optimal security. This type of optical control facilitated unlocking method is novel and original, bringing completely new experience to users. Furthermore, the lock cylinder assembly 200 is controlled by using a circuit. Therefore, other functions may be added by using the circuit, for example, loading a GPS positioning function or a weak current reminder function, to further enhance operational performance of the smart electronic lock.

In this embodiment, the smart electronic lock mainly includes the following constituent parts: the lock cylinder assembly 200, the key assembly 500, the upper fastening assembly 300, and the lower fastening assembly 400. The following describes the foregoing constituent parts in detail.

Figure 3:
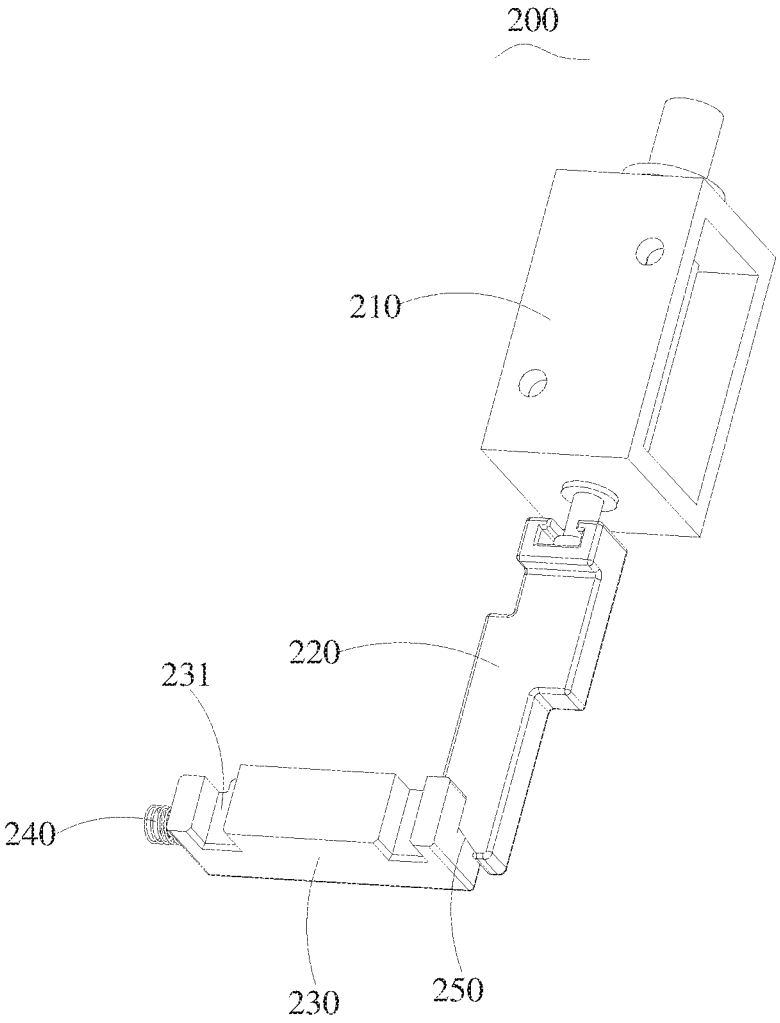
FIG. 3 is a schematic structural diagram of a lock cylinder assembly according to an embodiment of the present invention.

Referring to FIG. 3, the lock cylinder assembly 200 is disposed in the accommodating cavity 110 and is mainly configured to implement locking and unlocking of the electronic lock. The lock cylinder assembly 200 includes a vertically disposed electromagnet 210, a vertical pushrod 220 disposed at the bottom of the electromagnet 210, a horizontal pushrod 230 disposed at the bottom of the vertical pushrod 220, and a first elastic piece 240. One terminal of the horizontal pushrod 230 abuts against the bottom of the vertical pushrod 220 by using an inclined plane 250, and the first elastic piece 240 is disposed at the other terminal of the horizontal pushrod 230 for the horizontal pushrod 230 to return to position. After the electromagnet 210 is electrified, the electromagnet 210 moves downwards and exerts downward thrust force on the vertical pushrod 220. Because the vertical pushrod 220 and the horizontal pushrod 230 abut against each other by using the inclined plane 250, when the vertical pushrod 220 moves downwards, the horizontal pushrod 230 is pushed by using the inclined plane 250 to move in a horizontal direction and compresses the first elastic piece 240. After power supply to the electromagnet 210 is interrupted, the thrust force from the electromagnet 210 on the vertical pushrod 220 is removed, the first elastic piece 240 returns to position and drives the horizontal pushrod 230 to move horizontally, and the vertical pushrod 220 is pushed by using the inclined plane 250 again to move upwards.

Figure 4:
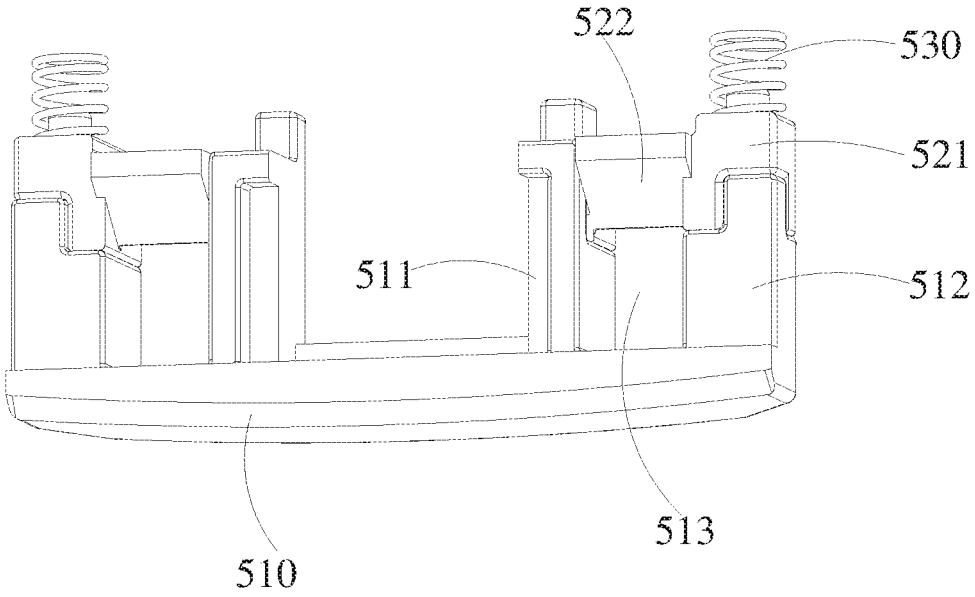
FIG. 4 is a schematic structural diagram of a key assembly according to an embodiment of the present invention.
Figure 5:
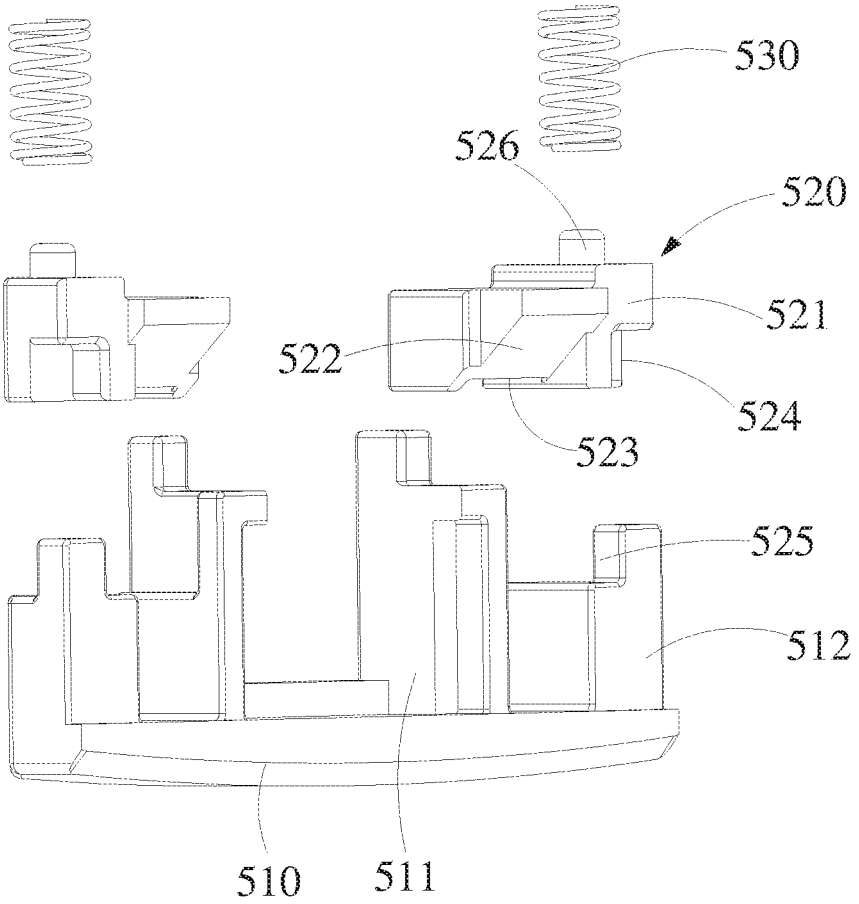
FIG. 5 is an exploded diagram of a key assembly according to an embodiment of the present invention.

The key assembly 500 is located beneath the horizontal pushrod 230. With reference to FIG. 4 and FIG. 5, the key assembly 500 includes a key 510, a push component 520 that is located on an inner side of the key 510 and that moves when pushed by the key 510, and a second elastic piece 530 disposed on the push component 520. Two inner pushrods 511 that protrude inwardly in parallel are disposed on the inner side of the key 510, outer sides of the two inner pushrods 511 are further separately provided with an ejector pin 512. Correspondingly, there are two push components 520, and the two push components 520 are correspondingly located on inner sides of the two ejector pins 512.

Figure 9:
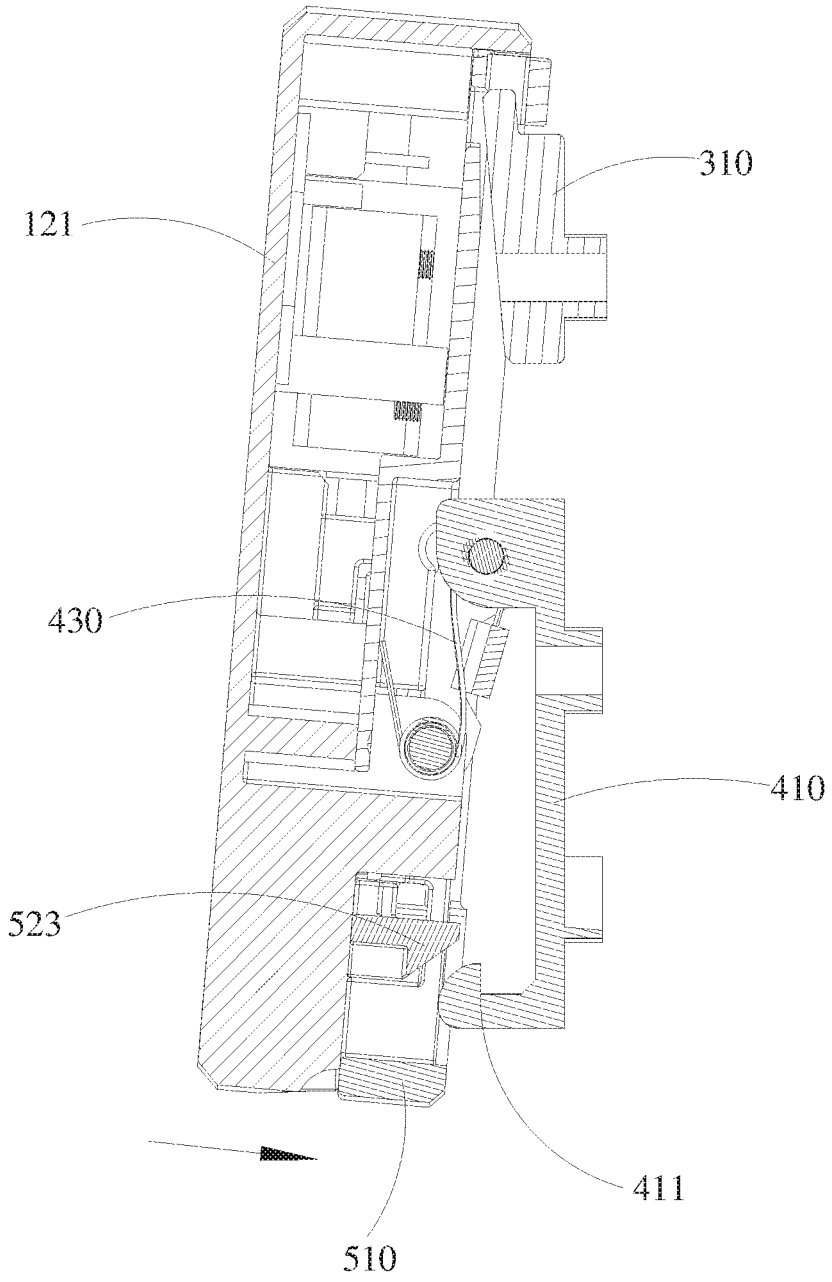
FIG. 9 is a cross-sectional side view of a smart electronic lock according to an embodiment of the present invention when the smart electronic lock is locked.

The push component 520 includes a horizontally disposed connecting portion 521 and clamping portion 522. The connecting portion 521 correspondingly aligns with the ejector pin 512, and the clamping portion 522 is located between the ejector pin 512 and the inner pushrod 511. Because there is a gap 513 between the ejector pin 512 and the inner pushrod 511, the clamping portion 522 is located at the gap 513. With reference to FIG. 9, an edge that is of the clamping portion 522 of each push component 520 and that faces the lower fastening assembly 400 protrudes downwards to form a first hook 523, and a clamping structure in the lower fastening assembly 400 extends into the gap 513 and clamps onto the first hook 523. A stepwise first fitting surface 524 is provided on the connecting portion 521 on a surface towards the key 510, a stepwise second fitting surface 525 is provided on each of the two ejector pins 512 on a surface towards the push component 520, and steps of the first fitting surface 524 and steps of the second fitting surface 525 engage in a staggered manner. In this embodiment, the key 510 and the push component 520 are two independent parts. Therefore, setting of this type of stepwise fitting surface structures can ensure that the key 510 can accurately push the push component 520 when being moved. A first fastening post 526 is disposed on the connecting portion 521 on a surface away from the key 510. The second elastic piece 530 is a spring. One terminal of the spring is sleeved on the first fastening post 526, and with reference to FIG. 11, the other terminal of the spring abuts against a second fastening post 112 in the accommodating cavity 110.

Figure 6:
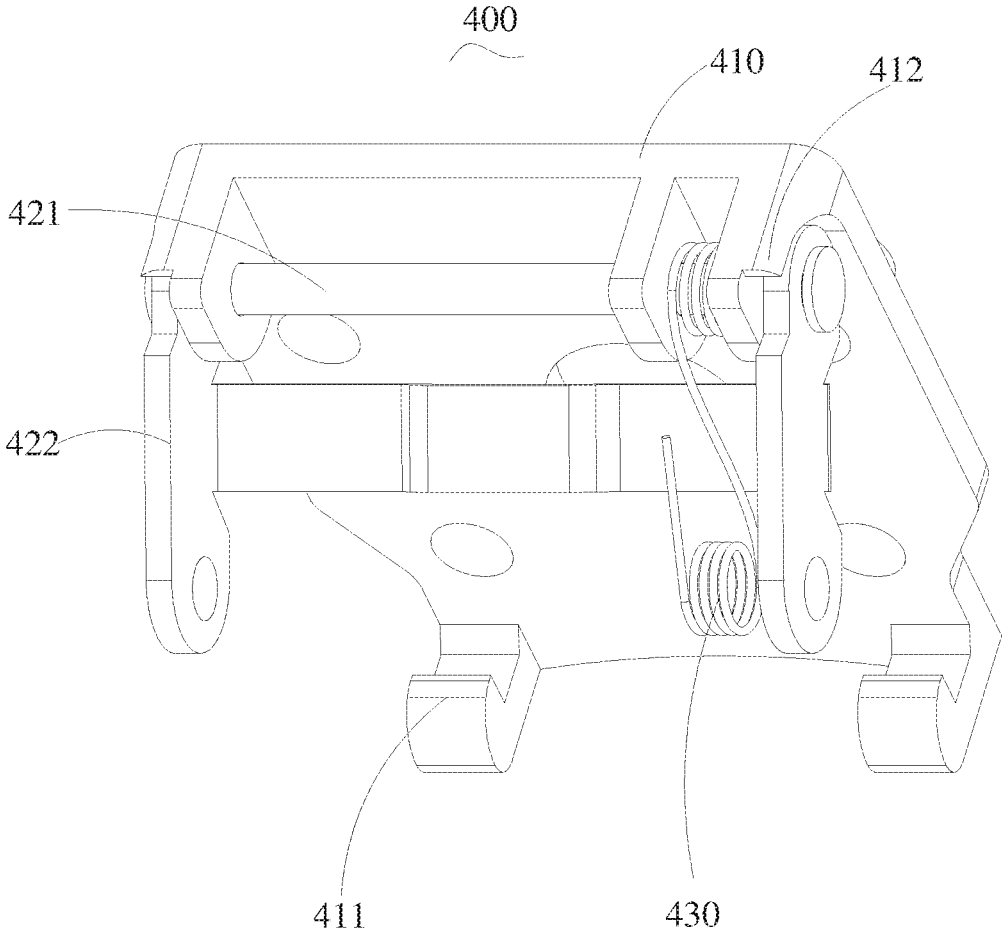
FIG. 6 is a schematic structural diagram of a lower fastening assembly according to an embodiment of the present invention.

With reference to FIG. 2 and FIG. 6, in this embodiment, the lower fastening assembly 400 that is fastened and locked to the key assembly 500 includes a fastening plate 410, and an actuator 420 and a torsional spring 430 that are disposed rotationally on an inner side of the fastening plate 410. Two second hooks 411 that can clamp onto the two first hooks 523 are extended from the interior bottom of the fastening plate 410. Two mounting portions 412 are disposed opposite to each other on the interior top of the fastening plate 410. The actuator 420 includes a rotating shaft 421 and two supporting arms 422 that are disposed opposite to each other. The rotating shaft 421 is placed horizontally, and two terminal parts of the rotating shaft 421 are respectively fastened to the two mounting portions 412. The two supporting arms 422 are placed obliquely. Top terminals of the two supporting arms 422 are respectively fastened to the two terminals of the rotating shaft 421, and bottom terminals of the two supporting arms 422 are separately fastened to the housing 100. Specifically, two mounting plates 111 that protrude from an outer side of the rear shell 130 are disposed in the accommodating cavity 110, and the bottom terminals of the two supporting arms 422 are respectively connected to the two mounting plates 111 fixedly by using a steady pin 600. The torsional spring 430 is sleeved on the rotating shaft 421, one terminal of the torsional spring 430 abuts against the inner side of the fastening plate 410, and the other terminal of the torsional spring 430 abuts against the rear shell 130.

Figure 7:
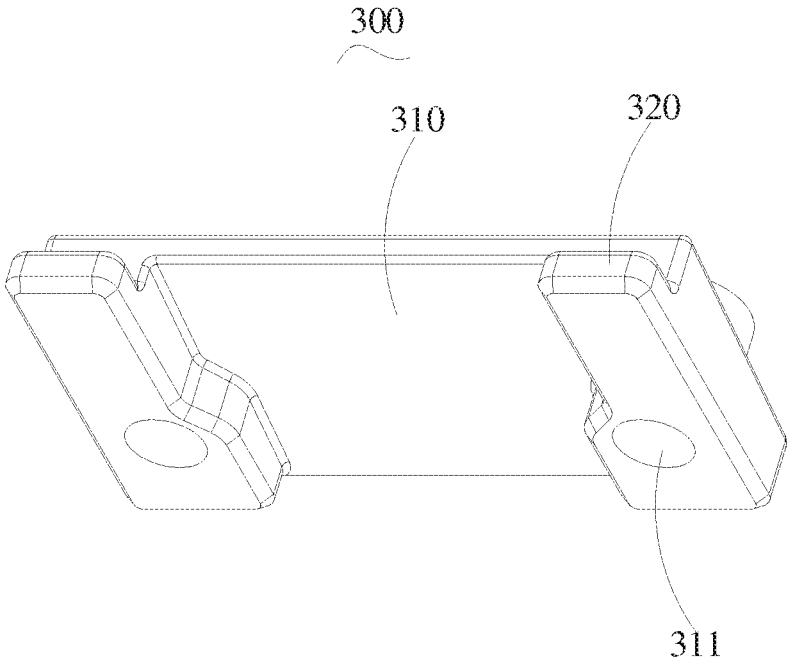
FIG. 7 is a schematic structural diagram of an upper fastening assembly according to an embodiment of the present invention.

With reference to FIG. 1, FIG. 2, and FIG. 7, the snap-fit structure 131 on the rear shell 130 is two clamping grooves disposed on the rear shell 130, and openings of the two clamping grooves face downwards. The upper fastening assembly 300 includes a fastener 310 and two protrusions 320 that are disposed on the fastener 310, and the two protrusions 320 protrude upwards. Certainly, after locations of the snap-fit structure 131 and the key assembly 500 are exchanged, that is, when the snap-fit structure 131 is disposed at the bottom of the rear shell 130, an opening direction of the clamping groove is correspondingly adjusted to facing upwards, and orientations of the two protrusions 320 on the fastener 310 are correspondingly adjusted to facing downwards. A mounting hole 311 is disposed on the fastener 310. When the smart electronic lock is applied to a suitcase, the fastener 310 is fastened to a case cover by using a screw that penetrates through the mounting hole 311.

Referring to FIG. 8, the sensor 122 disposed on the panel 121 of the front shell 120 is a sensing lens and can receive light emitted by a mobile APP.

Figure 10:
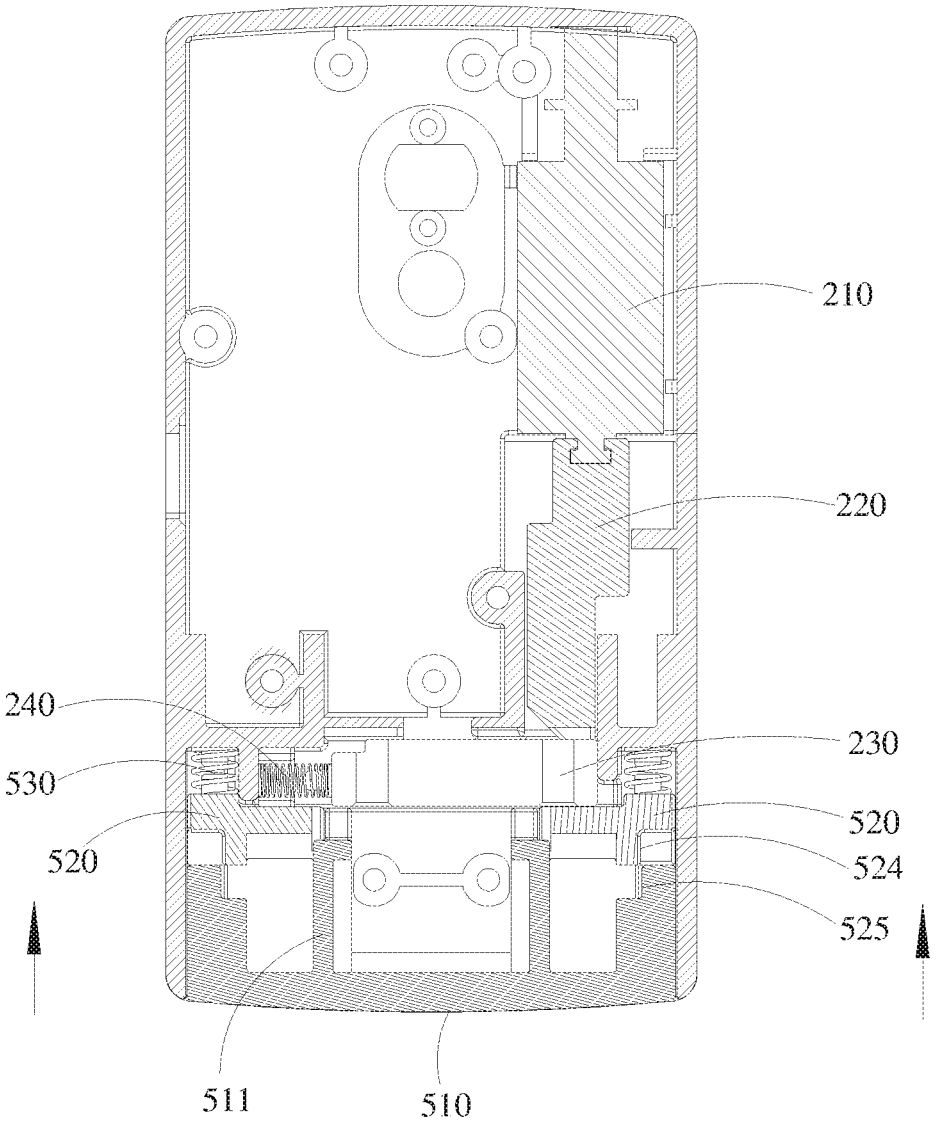
FIG. 10 is a cross-sectional rear view of a smart electronic lock according to an embodiment of the present invention when the smart electronic lock is locked.

Referring to FIG. 9, during locking, first, the housing 100 is pressed downwards, so that the two clamping grooves on the rear shell 130 snap-fit to the two protrusions 320 on the upper fastening assembly 300, to implement preliminary snap-fitting between the housing 100 and the case cover. Then, a lower portion of the housing 100 is pressed inwardly, so that the second hooks 411 on the lower fastening assembly 400 that is corresponding to the lower portion of the housing 100 moves forwards under the action of pressure to extend into the gap 513 in the key 510 and abut against the push component 520 along a fitting surface between the second hook 411 and the first hook 523. In this way, the second elastic piece 530 is pressed, making the second hook 411 slide into an inner side of the first hook 523 and clamp onto the first hook 523 reversely. The second elastic piece 530 bounces back and presses downwards against the push component 520. This ensures that the first hook 523 is securely clamped onto the second hook 411. In this case, the two terminals of the torsional spring 430 of the lower fastening assembly 400 respectively press against an inner side of the fastener 410 and the rear shell 130. So far, the smart electronic lock has been locked. Referring to FIG. 10, in this process, the horizontal pushrod 230 and the first elastic piece 240 in the lock cylinder assembly 200 remain at original locations because they are free of exogenic action. In addition, a clearance slot 231 is disposed on the horizontal pushrod 230. In a locked state, the clearance slot 231 and a terminal portion of the inner pushrod 511 on the key 510 are staggered, and the terminal portion of the inner pushrod 511 abuts against the horizontal pushrod 230, so that the electronic lock cannot be opened.

Figure 11:
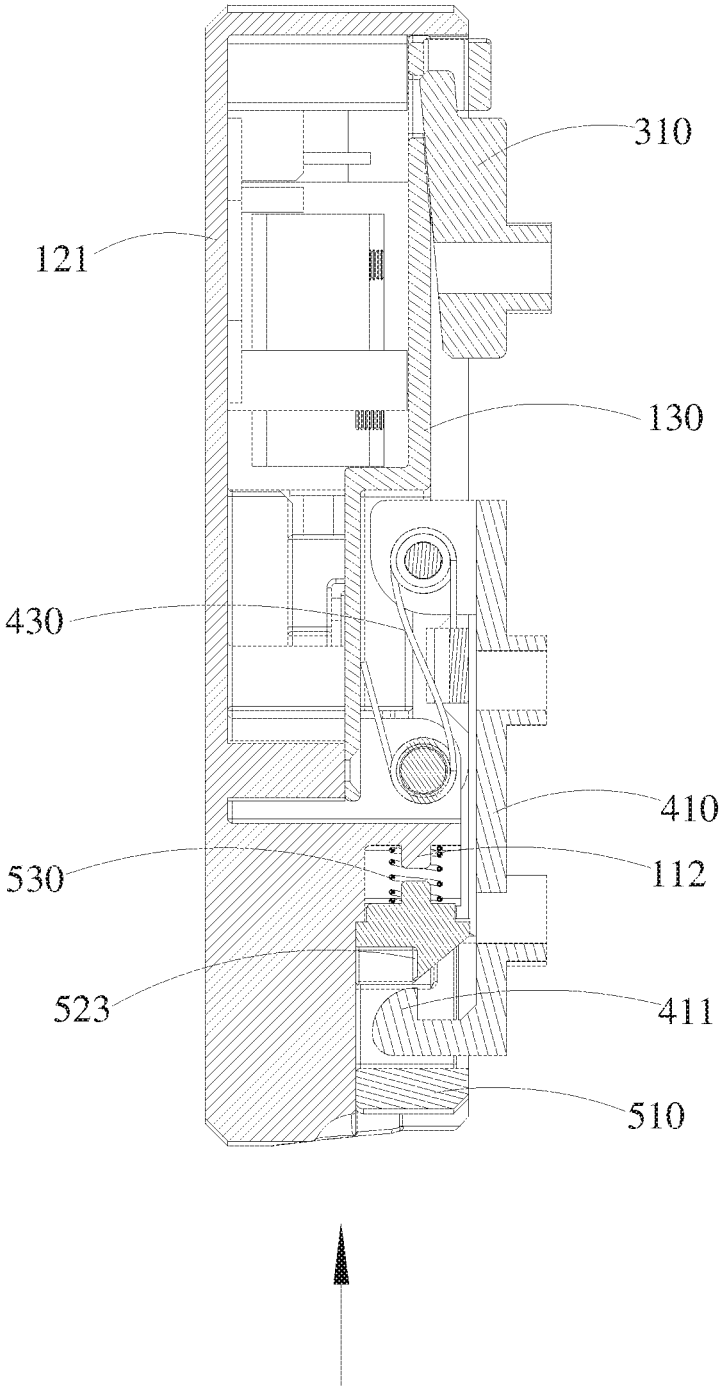
FIG. 11 is cross-sectional side view 1 of a smart electronic lock according to an embodiment of the present invention when the smart electronic lock is unlocked.
Figure 12:
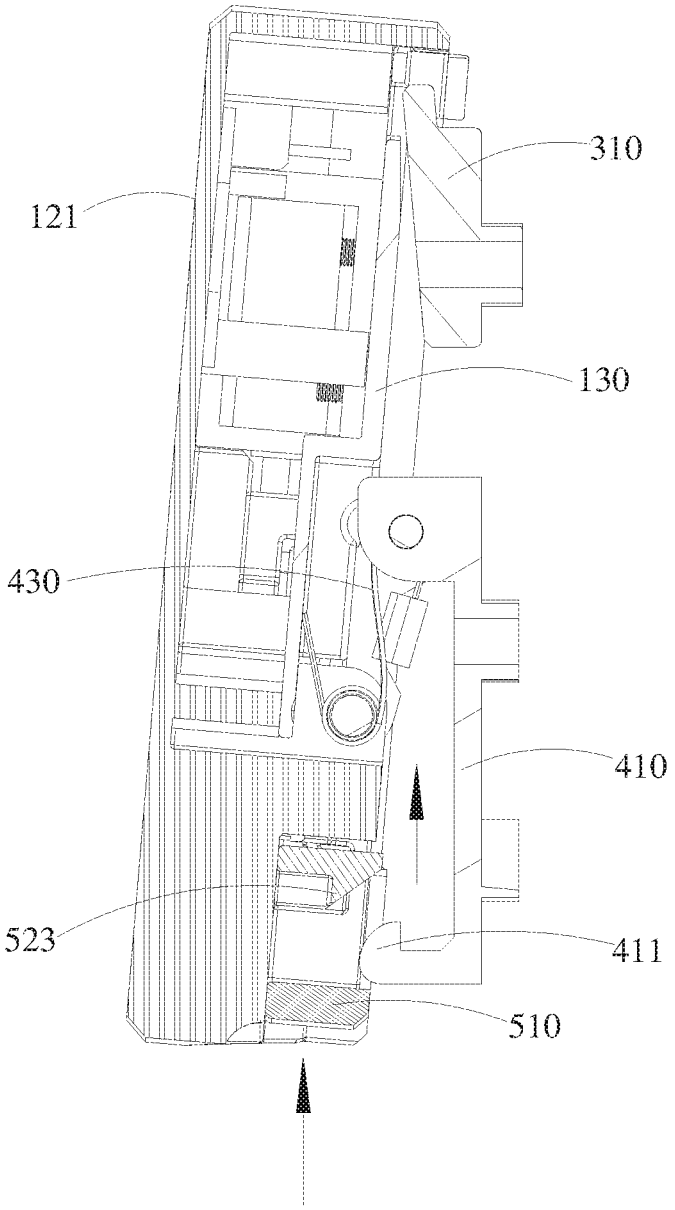
FIG. 12 is cross-sectional side view 2 of a smart electronic lock according to an embodiment of the present invention when the smart electronic lock is unlocked.
Figure 13:
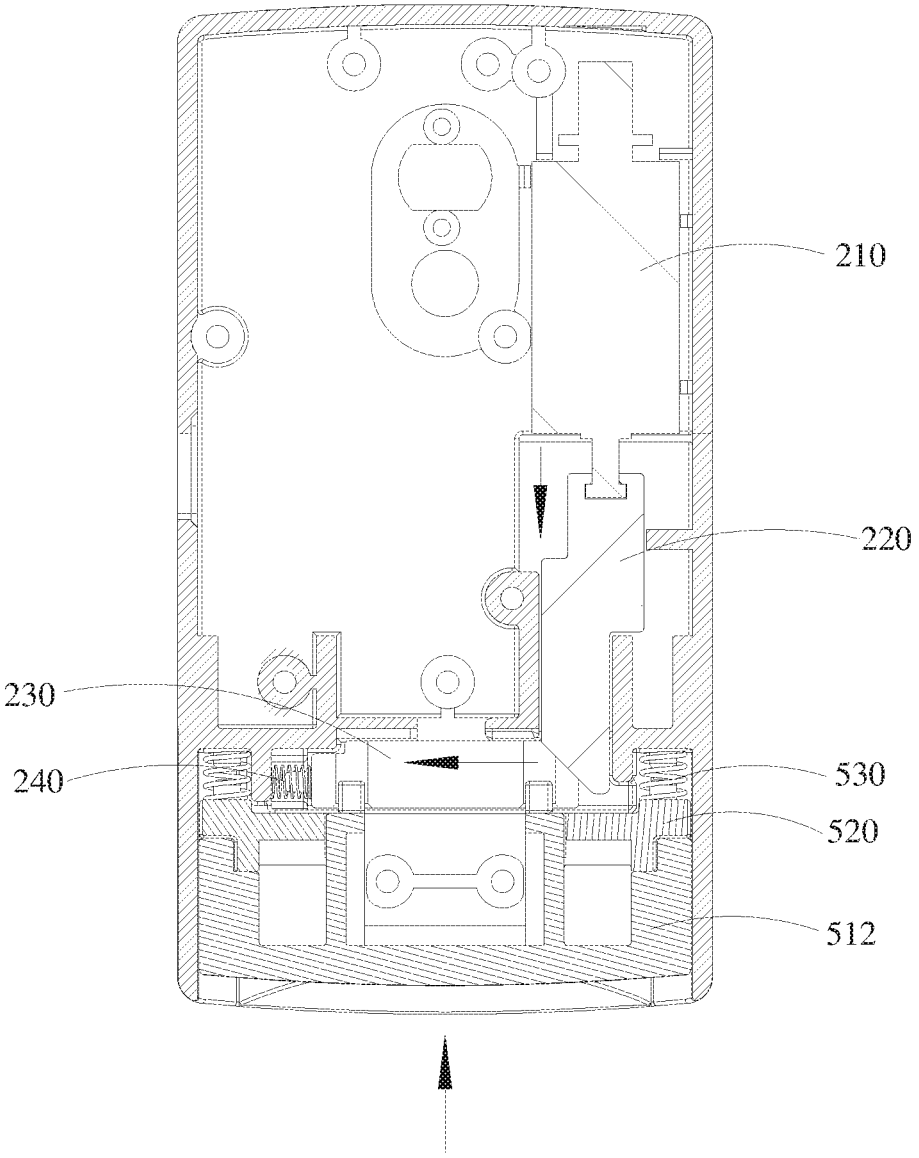
FIG. 13 is a cross-sectional rear view of a smart electronic lock according to an embodiment of the present invention when the smart electronic lock is unlocked.

Referring to FIG. 11 and FIG. 12, during unlocking, a mobile APP or a dedicated optical key is used to emit light to send an optical signal to the sensor 122, and the circuit board assembly is used to convert the optical signal into an electrical signal. After receiving the electrical signal, the electromagnet 210 of the lock cylinder assembly 200 moves downwards and drives the vertical pushrod 220 to move downwards. In addition, with reference to FIG. 13, the horizontal pushrod 230 moves horizontally when pushed by the vertical pushrod 220, and compresses the first elastic piece 240. When the clearance slot 231 on the horizontal pushrod 230 moves to a location corresponding to that of the inner pushrod 511, the horizontal pushrod 230 stops moving. In this case, the key assembly 500 is pressed upwards, and the key 510 drives the push component 520 and the second elastic piece 530 to move upwards. The inner pushrod 511 in the key 510 extends inwardly into the clearance slot 231. This ensures that the key 510 has a sufficient distance to push the push component 520. When the first hook 523 of the push component 520 is released from the second hook 411 of the lower fastening assembly 400, the housing 100 is pushed forward under a push action of elastic force of the torsional force 430, and the lower fastening assembly 400 and the key assembly 500 are separated and unlocked. Finally, the housing 100 is pulled upwards, so that the clamping groove on the top of the rear shell 130 is separated from the protrusion 320 on the upper fastening assembly 300, thereby completely separating the housing 100 from the upper fastening assembly 300 and implementing unlocking between the case cover and the case body.

The present invention further provides a suitcase, including a case body and a case cover, where the foregoing smart electronic lock is disposed between the case body and the case cover. As described above, during mounting, the upper fastening assembly 300 of the smart electronic lock is fastened to an edge of the case cover, and the lower fastening assembly 400 is fastened to an edge of a case body. In addition, the housing 100 and various internal parts are fixedly connected to the lower fastening assembly 400. The foregoing smart electronic lock is disposed. Therefore, a user can implement unlocking conveniently and rapidly by using a mobile APP, avoiding the problem that the password is forgotten because the lock has not been used for a long time. In addition, the lock cylinder assembly 200 is mounted inside a lock body, preventing the lock from being illegally unlocked by using other methods and featuring optimal security. This type of optical control facilitated unlocking method is novel and original, bringing completely new experience to users. Furthermore, the lock cylinder assembly 200 is controlled by using a circuit. Therefore, other functions may be added by using the circuit, for example, loading a GPS positioning function or a weak current reminder function, to further enhance operational performance of the suitcase.

The foregoing descriptions are merely preferable embodiments of the present invention and are not intended to limit the present invention. Any modification, equivalent replacement, and improvement made within the spirit and principle of the present invention shall fall within the protection scope of the present invention.

What is claimed is:

1. A smart electronic lock, comprising a housing that is enclosed by a front shell and a rear shell and that has an accommodating cavity, a lock cylinder assembly disposed in the accommodating cavity, and two fastening assemblies, wherein the two fastening assemblies are respectively correspondingly located at an upper portion and a lower portion of the back of the rear shell, the housing is provided with a snap-fit structure that snap-fits to one of the fastening assemblies in an upward/downward direction, the housing is provided with a key assembly that is fastened and locked to the other fastening assembly in a forward/backward direction, so as to implement a locking function of the smart electronic lock, the fastening assembly that is fastened and locked to the key assembly is fixedly connected to the housing, a panel of the front shell is provided with a sensor for receiving an optical control signal, a circuit board assembly for converting an optical signal received by the sensor into an electrical signal is provided in the accommodating cavity, and the lock cylinder assembly moves under control of the circuit board assembly, so that when the key assembly is pressed, the other fastening assembly drives the key assembly in the forward/backward direction to release from the key assembly;

wherein the lock cylinder assembly comprises a vertically disposed electromagnet, a vertical pushrod that is disposed at the top or bottom of the electromagnet and that can move in an upward/downward direction when pushed by the electromagnet, a horizontal pushrod disposed at the top or bottom of the vertical pushrod, and a first elastic piece, wherein one terminal of the horizontal pushrod abuts against a top terminal or a bottom terminal of the vertical pushrod by using an inclined plane, and the first elastic piece is disposed at the other terminal of the horizontal pushrod for the horizontal pushrod to return to position.

2. The smart electronic lock according to claim 1, wherein the key assembly comprises a key, a push component that is located on an inner side of the key and that moves when pushed by the key, and a second elastic piece that is disposed on the push component and that abuts against the interior of the accommodating cavity, wherein a first hook is disposed on the push component, an inner pushrod that protrudes inwardly is disposed on the inner side of the key, and a clearance slot is disposed on the horizontal pushrod; in a locked state, the first hook on the push component is fastened and locked to one of the fastening assemblies and a terminal portion of the inner pushrod abuts against the horizontal pushrod; and during unlocking, the horizontal pushrod moves under an action of the vertical pushrod, and when the key is pressed, the terminal portion of the inner pushrod extends into the clearance slot and the key drives the push component to move so that the first hook is separated from the fastening assembly.

3. The smart electronic lock according to claim 2, wherein there are two inner pushrods, the two inner pushrods are disposed in parallel on the inner side of the key, two ejector pins are further disposed on the inner side of the key, the two ejector pins are respectively located on outer sides of the two inner pushrods, and there are two push components, which are respectively located on inner sides of the two ejector pins.

4. The smart electronic lock according to claim 3, wherein a stepwise first fitting surface is provided on each of the two push components on a surface towards the key, a stepwise second fitting surface is provided on each of the two ejector pins on a surface towards the push component, and steps of the first fitting surface and steps of the second fitting surface engage in a staggered manner.

5. The smart electronic lock according to claim 1, wherein the fastening assembly that is fastened and locked to the key assembly comprises a fastening plate, and an actuator and a torsional spring that are disposed rotationally on an inner side of the fastening plate, wherein the terminal that is of the fastening plate and that is away from the fastening plate is fastened to the housing, and a second hook that snap-fits to the key assembly is disposed on the inner side of the fastening plate.

6. The smart electronic lock according to claim 5, wherein the actuator comprises a rotating shaft that is fastened horizontally on the inner side of the fastening plate and two supporting arms that are disposed opposite to each other, top terminals of the two supporting arms are respectively fastened to two terminals of the rotating shaft, bottom terminals of the two supporting arms are separately fastened to the housing, the torsional spring is sleeved on the rotating shaft, one terminal of the torsional spring abuts against the inner side of the fastening plate, and the other terminal of the torsional spring abuts against the rear shell.

7. The smart electronic lock according to claim 5, wherein two mounting plates that protrude from an outer side of the rear shell are disposed in the accommodating cavity, and the two supporting arms are respectively connected to the two mounting plates fixedly by using a steady pin.

8. The smart electronic lock according to claim 1, wherein the snap-fit structure is two clamping grooves disposed on the rear shell, and the fastening assembly that snap-fits to the snap-fit structure comprises a fastener and two protrusions that are disposed on the fastener and that are inserted into the two clamping grooves in an upward/downward direction.

9. A suitcase, comprising a case body and a case cover, wherein the smart electronic lock according to claim 1 is disposed between the case body and the case cover.

10. The suitcase according to claim 9, wherein the key assembly comprises a key, a push component that is located on an inner side of the key and that moves when pushed by the key, and a second elastic piece that is disposed on the push component and that abuts against the interior of the accommodating cavity, wherein a first hook is disposed on the push component, an inner pushrod that protrudes inwardly is disposed on the inner side of the key, and a clearance slot is disposed on the horizontal pushrod; in a locked state, the first hook on the push component is fastened and locked to one of the fastening assemblies and a terminal portion of the inner pushrod abuts against the horizontal pushrod; and during unlocking, the horizontal pushrod moves under an action of the vertical pushrod, and when the key is pressed, the terminal portion of the inner pushrod extends into the clearance slot and the key drives the push component to move so that the first hook is separated from the fastening assembly.

11. The suitcase according to claim 10, wherein there are two inner pushrods, the two inner pushrods are disposed in parallel on the inner side of the key, two ejector pins are further disposed on the inner side of the key, the two ejector pins are respectively located on outer sides of the two inner pushrods, and there are two push components, which are respectively located on inner sides of the two ejector pins.

12. The suitcase according to claim 11, wherein a stepwise first fitting surface is provided on each of the two push components on a surface towards the key, a stepwise second fitting surface is provided on each of the two ejector pins on a surface towards the push component, and steps of the first fitting surface and steps of the second fitting surface engage in a staggered manner.

13. The suitcase according to claim 9, wherein the fastening assembly that is fastened and locked to the key assembly comprises a fastening plate, and an actuator and a torsional spring that are disposed rotationally on an inner side of the fastening plate, wherein the terminal that is of the fastening plate and that is away from the fastening plate is fastened to the housing, and a second hook that snap-fits to the key assembly is disposed on the inner side of the fastening plate.

14. The suitcase according to claim 13, wherein the actuator comprises a rotating shaft that is fastened horizontally on the inner side of the fastening plate and two supporting arms that are disposed opposite to each other, top terminals of the two supporting arms are respectively fastened to two terminals of the rotating shaft, bottom terminals of the two supporting arms are separately fastened to the housing, the torsional spring is sleeved on the rotating shaft, one terminal of the torsional spring abuts against the inner side of the fastening plate, and the other terminal of the torsional spring abuts against the rear shell.

15. The suitcase according to claim 13, wherein two mounting plates that protrude from an outer side of the rear shell are disposed in the accommodating cavity, and the two supporting arms are respectively connected to the two mounting plates fixedly by using a steady pin.

16. The suitcase according to claim 9, wherein the snap-fit structure is two clamping grooves disposed on the rear shell, and the fastening assembly that snap-fits to the snap-fit structure comprises a fastener and two protrusions that are disposed on the fastener and that are inserted into the two clamping grooves in an upward/downward direction.

* * * * *